US008343882B2

(12) United States Patent
Johnson et al.

(10) Patent No.: US 8,343,882 B2
(45) **Date of Patent: *Jan. 1, 2013**

(54) CONSUMER SCRUBBING WIPE ARTICLE AND METHOD OF MAKING SAME

(75) Inventors: Mitchell T. Johnson, St. Paul, MN (US); Timothy J. Lindquist, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/886,282

(22) Filed: Sep. 20, 2010

(65) Prior Publication Data

US 2011/0005016 A1 Jan. 13, 2011

Related U.S. Application Data

(63) Continuation of application No. 10/167,045, filed on Jun. 11, 2002, now Pat. No. 7,829,478.

(51) Int. Cl.
*B32B 27/12* (2006.01)

(52) U.S. Cl. ..... 442/101; 442/149; 442/63; 428/141

(58) Field of Classification Search ..... 442/101, 442/149, 63

See application file for complete search history.

(56) References Cited

U.S. PATENT DOCUMENTS

| | | | | |
|---|---|---|---|---|
| 3,382,058 | A * | 5/1968 | Wise et al. | 51/295 |
| 4,002,775 | A | 1/1977 | Kabara | |
| 4,659,609 | A | 4/1987 | Lamers et al. | |
| 4,775,582 | A | 10/1988 | Abba et al. | |
| 4,833,003 | A | 5/1989 | Win et al. | |
| 4,853,281 | A | 8/1989 | Win et al. | |
| 5,213,588 | A | 5/1993 | Wong et al. | |
| 5,219,887 | A | 6/1993 | Andrews et al. | |
| 5,310,590 | A | 5/1994 | Tochacek et al. | |
| 5,354,401 | A | 10/1994 | Asahi et al. | |
| 5,378,731 | A | 1/1995 | Andrews et al. | |
| 5,380,756 | A | 1/1995 | Andrews et al. | |
| 5,460,802 | A | 10/1995 | Asami et al. | |
| 5,683,971 | A | 11/1997 | Rose et al. | |
| 5,962,001 | A | 10/1999 | Rose et al. | |
| 2002/0031556 | A1 | 3/2002 | Lindahl | |
| 2003/0003836 | A1 * | 1/2003 | Schindler et al. | 442/417 |
| 2003/0124935 | A1 | 7/2003 | Smith et al. | |

FOREIGN PATENT DOCUMENTS

| | | |
|---|---|---|
| DE | 19871878 A1 | 5/2000 |
| DE | 19851878 | * 11/2000 |
| EP | 0211664 | 2/1987 |
| FR | 2728283 | 6/1996 |
| WO | WO 02090483 | 11/2002 |
| WO | WO 03/034889 | 5/2003 |

OTHER PUBLICATIONS

PCT International Search Report PCT/ISA/210.

* cited by examiner

*Primary Examiner* — Lynda Salvatore
(74) *Attorney, Agent, or Firm* — Trisha D. Adamson

(57) ABSTRACT

A consumer scrubbing wipe article is disclosed that includes a nonwoven substrate and a texture layer. The nonwoven substrate has a dry basis weight of less than about 300 g/m$^2$. A non-crosslinked, abrasive resin-based texture layer is printed onto at least one surface of the substrate such that the texture layer extends at least 50 microns outwardly beyond the substrate surface upon coalescing. The texture layer bonds to the surface of the substrate via coalescing, and includes resin characterized as independently imparting a scrubbyness attribute to the article upon coalescing.

20 Claims, 3 Drawing Sheets

CONSUMER SCRUBBING WIPE ARTICLE AND METHOD OF MAKING SAME

CROSS REFERENCE TO RELATED CASES

The present application is a continuation of U.S. patent application Ser. No. 10/167045 filed on Jun. 11, 2002, now U.S. Pat. No. 7,829,478

BACKGROUND OF THE INVENTION

The present invention relates to a consumer scrubbing wipe article. More particularly, it relates to nonwoven substrate-based scrubbing wipe article having a printed texture layer that provides enhanced scrubbing capabilities and is amenable to loading of the substrate with a variety of chemical solutions.

Consumers have long enjoyed the convenience of single-use, nonwoven-based wipes or wiping articles for cleaning various surfaces around the home. One common example is a paper towel. More recently, wipes loaded with cleaning or disinfecting/sanitizing chemicals have become increasingly popular. These products are useful for not only cleaning stains from surfaces, but also disinfect, to a certain extent, the contacted surface. In general terms, typical loaded wipe products (i.e., nonwoven substrate with liquid or dry chemicals absorbed into the nonwoven substrate) include a nonwoven substrate composed of short fibers that are resin bound to add strength when wet. These resins are normally anionic in nature. However, the use of nonionic or cationic binder resins has been on the increase since the cleaning/disinfecting/sanitizing solutions mainly used for loaded wipes is a cationic quaternary ammonium sale. The nonionic or cationic binder resin provides the most reliable release of the quaternary ammonium salt from the substrate. While the quaternary ammonium salt serves as an effective anti-microbial agent, certain potential drawbacks have been identified such as overt drying of the user's hand after repeated use and lack of compatibility with other chemicals and substrates.

Beyond the identified cleaning solution disadvantages, disinfecting wipes fail to address an additional consumer preference. Namely, consumers oftentimes desire to use the wipe for cleaning tasks requiring scrubbing or scouring. For example, it is difficult, if not impossible, to remove dried food from a countertop using an inherently soft disinfecting wipe (or non-disinfecting wipe). Conversely, however, consumers strongly prefer that the wipe not be overly rigid (in other words, that the wipe be drapeable) for ease of use, minimizing injury to the user's hand, etc. As such, for many applications, commercially available scouring pads are simply not acceptable.

Attempts to address the above-identified concerns have been met with limited success. In general terms, currently available consumer wipe products that purport to have a "scrubbyness" attribute generally include a nonwoven base substrate onto which thermoplastic fibers are meltblown. One example of this technique is described in U.S. Pat. No. 4,659,609 to Lamers et al. In theory, the meltblown fibers provide an abrasive texture surface to the resulting wipe. In practice, however, the meltblown fibers are only marginally more "abrasive" than the base substrate itself due in large part to the extremely thin nature of the blown fibers (typically less than 10 microns in diameter), as well as the random nature in which the fibers are dispersed over the substrate's surface.

Alternatively, U.S. Pat. No. 5,213,588 to Wong et al., describes an abrasive wipe consisting of a nonwoven substrate having printed thereon a cured scrubbing bead mixture.

Wong is focused upon using a paper towel-like base substrate that may be less durable than other nonwoven materials. Nonetheless, the printed nature of the scrubbing layer does facilitate formation of a viable texture pattern as compared to meltblown fibers. Further, the scrubbing bead mixture technique of Wong entails a relatively lengthy manufacturing cycle due to requisite curing (or crosslinking) of the scrubbing bead mixture resin. The mixture, prior to printing, contains polymeric abrasive particles having a diameter(s) of 20-400 microns. The printed mixture (otherwise including the particles) extends 40-300 microns beyond the substrate's surface. It is believed that the wipe of Wong obtains this raised pattern due the large particles contained in the resin mixture. Finally, the scrubbing bead mixture of Wong is anionic. This characteristic overtly limits the types of chemical solutions that can be "loaded" into the wipe. In particular, the Wong scrubbing wipe cannot be loaded with certain aqueous cleaning agents that are cationic, for example quaternary ammonium salts. Conversely, other scrubbing wipe products incorporate a cationic resin nonwoven substrate and/or a texture layer that is cationic-based, and thus cannot be loaded with an anionic chemical solution.

Consumer demand for scrubbing wipe products continues to grow. Unfortunately, currently available wipe products do not provide an acceptable level of scrubbyness, are limited in the types of chemical solutions that can be delivered and/or entail rigorous manufacturing requirements. Therefore, a need exists for a consumer scrubbing and wiping article that has a high degree of scrubbyness, promotes easy handling by the user, and is capable of being loaded with a wide variety of chemical solutions, as well as methods of manufacture.

SUMMARY OF THE INVENTION

One aspect of the present invention relates to a consumer scrubbing wipe article. The article includes a nonwoven substrate and a texture layer. The nonwoven substrate has a dry basis weight of less than about 300 g/m$^2$, and thus promotes easy, comfortable handling by a user. The texture layer is a non-crosslinked, abrasive resin-based material that is printed onto at least one surface of the nonwoven substrate. In this regard, the texture layer covers less than an entirety of the substrate surface and extends at least 50 microns outwardly beyond the substrate surface to which it is printed. This characteristic ensures that the scrubbing wipe article has a distinct scrubbyness attribute unlike other known, lightweight nonwoven wipes. In one preferred embodiment, the texture layer includes a resin characterized as independently imparting a scrubbyness attribute to the scrubbing wipe article upon coalescing and bonding to the nonwoven substrate. In another preferred embodiment, the wiping article further includes a chemical solution absorbed into the nonwoven substrate. In this regard, and in accordance with one more preferred embodiment, the chemical solution can be cationic, anionic, or neutral.

Another aspect of the present invention relates to a method of manufacturing a consumer scrubbing wipe article. The method includes providing a nonwoven substrate having a dry basis weight of less than about 300 g/m$^2$. An abrasive resin-based matrix is also provided. The matrix is printed onto a surface of the nonwoven substrate, covering less than an entirety of the surface. The printed matrix is then caused to coalesce (e.g., dry) to create a texture layer that provides a scrubbyness attribute. In this regard, the texture layer is created without crosslinking of the matrix resin. Once coalesced, the texture layer extends at least 50 microns outwardly beyond the substrate surface onto which it is printed. In one preferred embodiment, the texture layer is caused to coalesce via ambient temperature drying or exposure to infrared light/heat. In another preferred embodiment, the matrix is pattern-printed onto the nonwoven substrate in a manner that creates a plurality of repeated, discrete lines.

DESCRIPTION OF THE PREFERRED EMBODIMENTS

One preferred embodiment of a consumer scrubbing wipe article 10 in accordance with the present invention. As used throughout this specification, the term "consumer" is in reference to any household, industrial, hospital or food industry applications and the like of the article 10. In general terms, the article 10 consists of a nonwoven substrate 12 and a texture layer 14 (referenced generally in FIG. 1). As will be made more clear below, the nonwoven substrate 12 and the texture layer 14 can consist of a variety of different materials. Regardless, the texture layer 14 is characterized as including an abrasive, non-crosslinked resin and is printed to the nonwoven substrate 12. In particular, and with additional reference to FIG. 2, the nonwoven substrate 12 defines first and second opposing surfaces 16, 18. For purposes of illustration, thicknesses of the substrate 12 and the texture layer 14 are exaggerated in FIG. 2. The texture layer 14 is printed to one or both of the nonwoven substrate surfaces 16, 18. In one preferred embodiment, the scrubbing wipe article 10 further includes a chemical solution (not shown) loaded into, or absorbed by, the nonwoven substrate 12. Applicable chemical solutions are described in greater detail below. Notably, however, the texture layer 14 is preferably configured to accommodate a wide variety of chemical solutions including those that are neutral, cationic, or anionic. Further, the scrubbing wipe article 10 is equally useful without a chemical solution. In other words, the scrubbyness characteristic provided by the scrubbing wipe article 10 independently provides a user with an enhanced ability to clean and scrub numerous surfaces, such that a chemical solution is not a required element of the present invention.

Preferred compositions of the nonwoven substrate 12 and the texture layer 14, as well as processing thereof, are provided below. To this end, the scrubbing wipe article 10 is described as providing a "scrubbyness" attribute that is markedly improved over known, lightweight consumer wipe products. The term "scrubbyness" is in reference to an ability to abrade or remove a relatively small, undesirable item otherwise affixed to a surface as the wipe is moved back and forth over the item. A wipe substrate can be given a scrubbyness characteristic not only by forming a hardened scrubbing material on the substrate's surface (i.e., harder than the substrate itself), but also and perhaps more prominently via the extent to which the so-formed material extends from or beyond the substrate surface in conjunction with side-to-side spacing between individual sections of the scrubbing material. The printed texture layer 14 of the present invention provides and uniquely satisfies both of these scrubbyness requirements.

Figure 1:
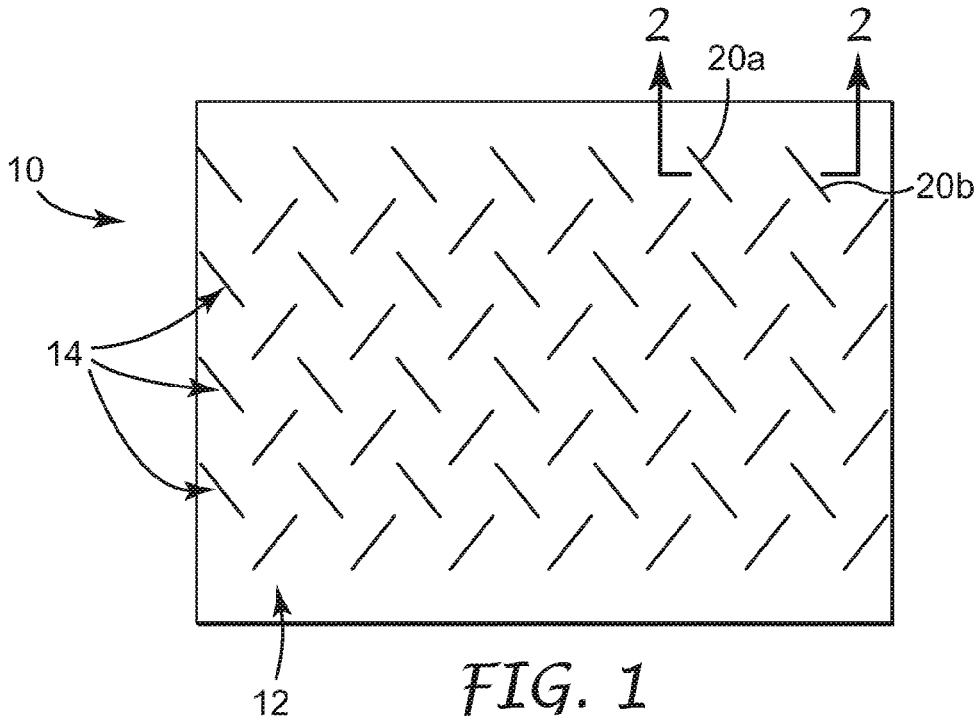
FIG. 1 is a plan view of an exemplary consumer scrubbing wipe article in accordance with the present invention.
Figure 3:
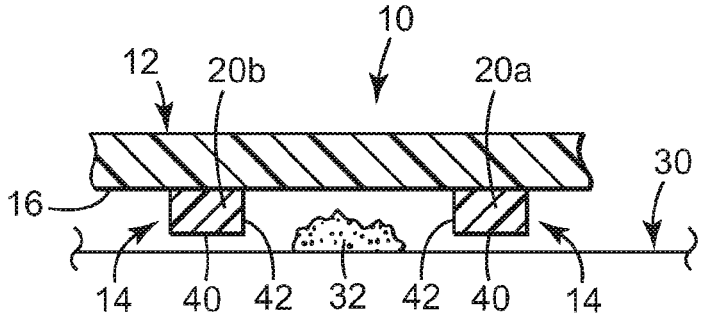
FIG. 3 is an enlarged, cross-sectional view of the article portion of FIG. 2 being applied to a surface.

By way of further explanation, the texture layer 14 defines a pattern on the substrate surface 16 that preferably includes a plurality of discrete sections (e.g., the various line-like sections shown in FIG. 1 and referenced generally at 20*a*, 20*b*). During a scrubbing application, a user (not shown) will normally position the scrubbing wipe article 10 such that the texture layer 14 is facing the surface to be cleaned. An example of this orientation is provided in FIG. 3 whereby the scrubbing wipe article 10 is positioned to clean a surface 30. As should be understood, the surface 30 to be cleaned is application specific, and can be relatively hard (e.g., a table top or cooking pan) or relatively soft (e.g., human skin). Regardless, the surface 30 to be cleaned may have a mass 32 that is undesirably affixed thereto. Again, the mass 32 will be unique to the particular cleaning application, but includes matters such as dirt, dried food, dried blood, etc. The scrubbing wipe article 10 of the present invention facilitates scrubbing removal of the mass 32 as a user repeatedly forces the texture layer 14 (or a portion thereof) back and forth across the mass 32. Each section (for example, the sections 20*a*, 20*b*) of the texture layer 14 must be sufficiently hard to either abrade or entirely remove the mass 32 during the scrubbing motion. In addition, the texture layer 14 must extend an appreciable distance from the substrate surface 16 to ensure intimate surface interaction with the mass 32 along not only an outer most surface 40, but along sides 42 as well. Notably, most cleaning wipes incorporating a blown fiber "scrubbing" or texture layer provide only a minimal thickness or extension relative to the substrate surface, likely giving rise to a less than desirable scrubbyness characteristic. Further, it is preferred that the discrete sections (for example, the sections 20*a*, 20*b*) provided by the texture layer 14 of the present invention be sufficiently spaced from one another to ensure intimate contact between the mass 32 and the sidewall 42 of the particular texture layer section 20*a*, 20*b* during a cleaning operation. This is readily achieved via the printing technique made available by the texture layer matrix of the present invention as described below.

With the above preferred performance parameters in mind, the nonwoven substrate 12 can assume a wide variety of forms that provide for a variety of different, desirable properties. Various materials and manufacturing techniques are described below. Regardless of the exact construction, however, the nonwoven substrate 12 is highly conducive to handling by a user otherwise using the wiping article 10 for cleaning purposes. In particular, consumers prefer that a cleaning wipe, such as the wiping article 10 of the present invention, be relatively supple or non-rigid. This desired characteristic allows the user to readily fold, squeeze, or otherwise manipulate the wiping article 10 in a manner most appropriate for the particular cleaning task. A relatively stiff or rigid substrate would greatly impede this desired form of use. The desired suppleness of the substrate 12 is best described with reference to a dry basis weight thereof. The nonwoven substrate 12 of the present invention has a dry basis weight of less than about 300 $g/m^2$, but preferably greater than about 30 $g/m^2$. In a more preferred embodiment, the nonwoven substrate 12 has a dry basis weight of less than about 200 $g/m^2$. Alternatively, the suppleness of the nonwoven substrate 12 can be expressed in terms of drapability. "Drapability" is defined as the inherent ability to conform to an irregular or non-flat surface. Drapability or "drape" is measured using INDA standard for "Handle-O-Meter Stiffness of Nonwoven Fabrics" IST 90.3 (95). With this in mind, the nonwoven substrate 12 preferably has a drapability value of less than about 250.

The nonwoven substrate 12 can be formed from a variety of materials and in a variety of fashions selected to provide desired properties, such as extensibility, elasticity, etc., in addition to the requisite suppleness. In most general terms, the substrate 12 is comprised of individual fibers entangled with one another (and optionally bonded) in a desired fashion. The fibers are preferably synthetic or manufactured, but may include natural materials such as wood pulp fiber. As used herein, the term "fiber" includes fibers of indefinite length (e.g., filaments) and fibers of discrete length (e.g., staple fibers). The fibers used in connection with the nonwoven substrate 12 may be multicomponent fibers. The term "multicomponent fiber" refers to a fiber having at least two distinct longitudinally coextensive structured polymer domains in the fiber cross-section, as opposed to blends where the domains tend to be dispersed, random, or unstructured. The distinct domains may thus be formed of polymers from different polymer classes (e.g., nylon and polypropylene) or be formed of polymers of the same polymer class (e.g., nylon) but which differ in their properties or characteristics. The term "multicomponent fiber" is thus intended to include, but is not limited to, concentric and eccentric sheath-fiber structures, symmetric and asymmetric side-by-side fiber structures, island-in-sea fiber structures, pie wedge fiber structures, and hollow fibers of these configurations.

In addition to the availability of a wide variety of different types of fibers useful for the nonwoven substrate 12, the technique for bonding the fibers to one another is also extensive. In general terms, suitable processes for making the nonwoven substrate 12 that may be used in connection with the present invention include, but are not limited to, spunbond, blown microfiber (BMF), thermal bonded, wet laid, air laid, resin bonded, spunlaced, ultrasonically bonded, etc. In a preferred embodiment, the substrate 12 is spunlaced utilizing a fiber sized in accordance with known spunlace processing techniques. With this most preferred manufacturing technique, one preferred construction of the nonwoven substrate 12 is a blend of 50/50 wt. % 1.5 denier polyester and 1.5 denier rayon at 50-60 g/m$^2$. The substrate 12 is first carded and then entangled via high-pressure water jets as is known in the art. The one preferred spunlace technique eliminates the need for a thermal resin bonding component, so that the resulting nonwoven substrate is amenable to being loaded with virtually any type of chemical solution (i.e., anionic, cationic, or neutral).

Figure 2:
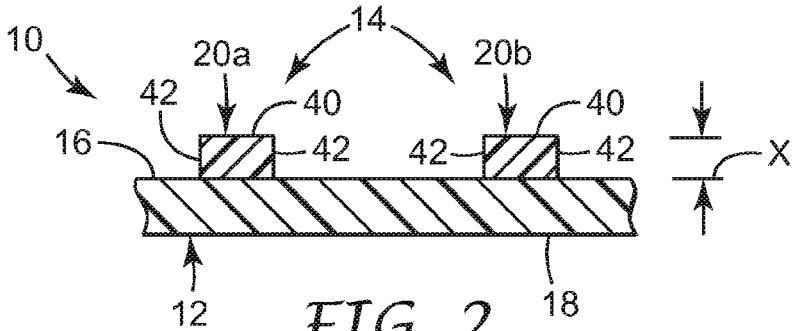
FIG. 2 is an enlarged, cross-sectional view of a portion of the article of FIG. 1 along the lines 2-2.

Although the nonwoven substrate 12 is depicted in the cross-sectional view of FIG. 2 as a single layer structure, it should be understood that the nonwoven substrate 12 may be of single or multi-layer construction. If multi-layered construction is used, it will be understood that the various layers may have the same or different properties, constructions, etc., as is known in the art. For example, in one alternative embodiment, the nonwoven substrate 12 is constructed of a first layer of 1.5 denier rayon and a second layer of 32 denier polypropylene. This alternative construction provides a relatively soft substrate, such that the resulting wiping article 10 is conducive for use cleaning a user's skin, akin to a facial cleansing wipe.

The texture layer 14 is, as previously described, an abrasive, non-crosslinked resin-based material. As described in greater detail below, the exact composition of the texture layer 14 can vary depending upon desired end performance characteristics. To this end, a texture layer matrix is initially formulated and then printed onto the substrate 12. This matrix will consist of the selected resin and may include additional constituents such as mineral(s), filler(s), colorant, thickeners, etc. Regardless of exact composition, however, the selected resin imparts, upon coalescing of the printed matrix (that otherwise achieves bonding of the matrix to the substrate 12), the desired scrubbyness characteristic to the wiping article 10. That is to say, unlike other techniques in which an added bead material is required to achieve and maintain a useful outward extension of the texture layer relative to the substrate surface (and thus provide a rigid surface against which scrubbing can be achieved), the resin associated with the texture layer 14 of the present invention independently extends an appreciable extent from the substrate 12 surface immediately following printing thereon. As a point of reference, the resin component is defined as "non-crosslinking" when referring to the texture layer matrix (i.e., prior to printing) and as "non-crosslinked" when referring to the printed, coalesced texture layer 14. This definitional distinction more accurately reflects that the matrix of the present invention does not require a crosslinking agent and the useful texture layer 14 is provided without a crosslinked resin.

The non-crosslinked, abrasive resin component of the texture layer 14 can assume a variety of forms, and may or may not be a thermalplastic. Importantly, however, the resin is of a type that does not require crosslinking to coalesce following printing. With this in mind, the abrasive, non-crosslinking resin can be a polyacrylate, modified polyacrylate, polyurethane, polyvinyl acetate, copolyamide, copolyester, or phenolic. Acceptable resin materials are available, for example, from Neste Resins Canada of Missuaga, Ontario, Canada under the trade designation "BB-077 Phenolic Resin"; from Air Products, Inc., of Chicago, Ill., under the trade name "Hybridur" (such as Hybridur 540, 560, 570, or 580), "Air-Flex Series" and "AirBond Series"; from Zeneca Resins of Wilmington, Mass. under the trade name "Zeneca A1052"; from EMS-Griltex of Sumter, S.C. under the trade name "P, VP or D-series", as a copolyester or copolyamide dispersion; as well as other latexes and polyurethanes. As described below, the particular resin, and weight percent relative to the texture layer matrix, can be fine-tuned to satisfy the desired end application constraints. However, the selected resin is characterized as being flowable in matrix form in a manner that will soak only partially into the nonwoven substrate 12 (i.e., will not soak through or wet out the substrate 12) upon printing thereto, and will coalesce upon exposure to various drying conditions. In this regard, thermal energy is required when copolyesters or copolyamides are used. Additionally, the resin component of the texture layer 14 is preferably non-ionic. Some of the exemplary acceptable resins listed above are non-ionic. The preferred non-ionic nature of the resin associated with the texture layer 14 of the present invention facilitates use of virtually any form of chemical solution where so desired.

In preferred embodiments, the texture layer 14 optionally further includes a particulate additive for enhanced hardness. To this end, and as described in greater detail below, the scrubbing wipe article 10 of the present invention is useful in a wide variety of potential applications having different scrubbing requirements. For some applications, it is desirable that the scrubbing wipe article 10, and in particular the texture layer 14, be more or less abrasive than others. While the above-described resin component of the texture layer 14 independently imparts a scrubbyness feature to the article 10 greater than other available wipes, this scrubbyness characteristic can be further enhanced via the addition of a particulate component. With this in mind, a wide variety of minerals or fillers as known in the art can be employed. Useful minerals include $Al_2O_3$, "Minex" (available from The Cary Co. of Addison, Ill.), $SiO_2$, $TiO_2$, etc. Exemplary fillers include $CaCO_3$, talc, etc. Where employed, the particulate component additive comprises less than 70% by weight of the texture layer 14, more preferably less than 50% by weight, most preferably less than 30% by weight. Further, the particulate component preferably consists of inorganic, hard, and small particles. For example, the "Minex" mineral particulate component has a median particle size of 2 microns and a Knoop hardness of about 560. Of course, other particle size and hardness values may also be useful. The preferred inorganic nature of the particulate component, in conjunction with the preferred non-ionic resin component, renders the resulting texture layer 14 amenable for use with any type of chemical solution.

The texture layer 14 can further include a colorant or pigment additive to provide a desired aesthetic appeal to the wiping article 10. Appropriate colorant agents are well known in the art, and include, for example, products sold under the trade name "Sunsperse" available from Sun Chemical Corp. of Amelia, Ohio. Other coloring agents as known in the art are equally acceptable but preferably comprise less than 1% of the texture layer matrix by weight.

The texture layer matrix can include additional components such as a thickening agent to achieve a viscosity most desirable for the particular printing technique employed and speed of the manufacturing line. In this regard, appropriate thickening agents are known in the art and include methylcellulose and a material available under the trade name "Rheolate 255" from Rheox, Inc. of Hightstown, N.J. Notably, the thickening agent may be unnecessary depending upon the selected resin and printing technique; however, where employed, the thickening agent preferably comprises less than approximately 5% by weight of the texture layer matrix.

Finally, and as previously described, the scrubbing wipe article 10 of the present invention can be used "dry" or can be loaded with a chemical solution. The term "loaded" is in reference to a chemical solution being absorbed by the nonwoven substrate 12 prior to being delivered to a user. During use, the chemical solution is released from the nonwoven substrate 12 as the user wipes the scrubbing wipe article 10 across a surface. Due to the preferred non-ionic nature of the texture layer 14, virtually any desired chemical solution can be loaded, including water, quaternary ammonium salt solutions, Lauricidin™-based anti-microbials, alcohol-based anti-microbials, citrus-based cleaners, solvent-based cleaners, cream polishes, anionic cleaners, amine oxides, etc. That is to say, where employed, the chemical solution can be anionic, cationic, or neutral.

Manufacture or formation of the scrubbing wipe article 10 of the present invention generally consists of formulating the appropriate texture layer matrix, printing the matrix onto the substrate 12, and then causing the printed matrix to coalesce that in turn bonds the matrix to the substrate 12, thereby resulting in the texture layer 14. Various techniques for actual printing of the matrix are described below. Importantly, however, the texture layer matrix is formulated such that the resin constituent does not crosslink as part of the coalescing step. That is to say, coalescing of the texture layer 14 does not entail "curing" in the traditional sense. Instead, the texture layer 14 coalesces through the release of water, such as by drying and/or exposure to infrared light. This represents a distinct advantage over other scrubbing wipe article forming techniques in which a lengthy curing period (on the order of 28 days) is required to achieve a sufficient hardness value.

Figure 4:
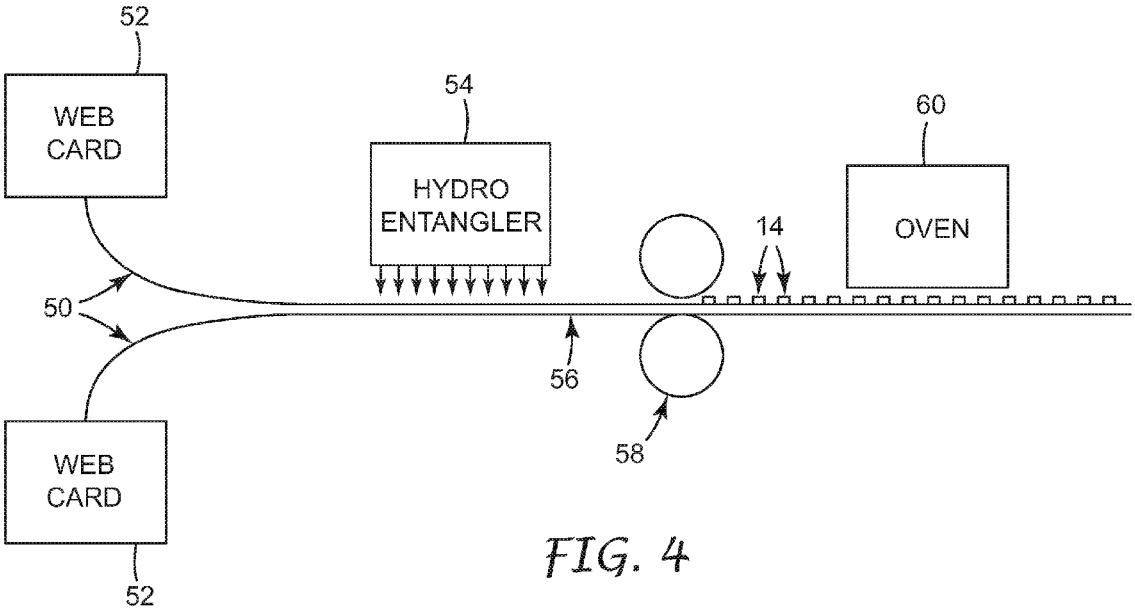
FIG. 4 is a simplified, block diagram of a method of manufacture in accordance with one embodiment of the present invention.

The texture layer matrix can be printed to the substrate 12 using a variety of known techniques such as screen printing, gravure printing, flexographic printing, etc. Several of these techniques are described in greater detail below. In one preferred embodiment, the printing operation is performed in-line with the nonwoven substrate 12 forming operation. In this regard, it will be recalled that the substrate 12 can be formed by a variety of known techniques including spunlace, wet laid, etc. With some of these techniques, a web of selected fiber material is carded and then entangled via high-pressure water jets. The resulting substrate is then dried. In this regard, other available scrubbing wipe products require that the substrate be completely dry prior to applying the texture layer (whether via printing or BMF). The article and method of the present invention is not so limited. Instead, the texture layer matrix can be printed onto the nonwoven substrate 12 while the substrate 12 is still wet. Subsequent drying of the nonwoven substrate 12 and the texture layer 14 can then be performed simultaneously, thereby eliminating a manufacturing step and greatly streamlining overall processing. This preferred in-line processing is illustrated in highly simplified, block form in FIG. 4. The substrate 12 is initially formed as a continuous, carded web 50 (via a carding device 52) and then entangled via a high-pressure water sprayer 54 to define a nonwoven substrate web 56. The texture layer matrix 14 (greatly exaggerated in FIG. 4) is printed to the web substrate 56 by a printer 58 (shown generally in FIG. 4 as including a roll-type printing device). An oven 60 then dries both the printed texture layer 14 and the substrate 12. Finally, the printed substrate can be wound and stored for later conversion, or immediately converted into individual articles 10. Alternatively, the articles 10 can be formed in-line as described, but printed as individual articles 10. Further, conventional processing methodologies can be employed.

In one preferred embodiment, the texture layer matrix is printed onto the nonwoven substrate 12 via conventional screen-printing. With this technique, an imaging sheet is formed to define a desired printing pattern, such as by punching or cutting the desired pattern into sheet metal. The imaging sheet is then placed over the nonwoven substrate 12, and in particular the desired surface 16, 18. The texture layer matrix is then delivered along an opposite side of the imaging sheet and forced on the nonwoven substrate 12 through the defined pattern to form the desired texture layer 14 pattern. The texture layer 14 is then coalesced and thus bonded to the substrate 12 in an appropriate manner, such as by placement in an oven at a relatively low temperature (on the order of 150° C. for a time period of less than about 2 minutes). Alternatively, the texture layer 14 is exposed to infrared light for a short period (less than about 2 minutes). Regardless, the texture layer 14 coalesces, and thus bonds to the substrate 12, and the scrubbing wipe article 10 is ready for use.

Alternatively, a gravure printing technique can be used. As is known in the art, the texture layer matrix is delivered onto the top of a gravure roll that otherwise forms recesses that define a desired pattern. A doctor blade is then used to push the matrix into the recesses. The texture layer matrix is then transferred to the nonwoven substrate 12 by passing the substrate 12 through a nip point defined by the gravure roll and a separate rubber roll. This technique is capable of providing a microreplicated design or pattern for the texture layer 14. Regardless, following printing, the texture layer 14 is coalesced and bonded to the substrate 12 as previously described.

Alternatively, flexographic printing can be employed in which a fountain roll delivers the texture layer matrix to a print plate cylinder via an intermediate anilox roll that controls the amount of matrix delivery. The nonwoven substrate 12 is then brought into contact with the print plate cylinder, with the texture layer matrix then being transferred or printed from the print plate cylinder to the substrate 12.

Regardless of the specific printing technique, the resulting substrate 12/texture layer 14 is immediately available for use in scrubbing and cleaning applications. Upon printing and subsequent coalescing of the matrix (and thus bonding to the substrate 12), the texture layer 14 is characterized by extending a distance (designated as "X" in FIG. 2) of at least 50 microns relative to the substrate surface to which the texture layer 14 is printed (i.e., the substrate surface 16 in FIG. 1). More preferably, the texture layer 14 extends at least 100 microns from the corresponding substrate surface; even more preferably at least 150 microns. Notably, a texture layer 14 extension value of at least 50 microns is not found in known, lightweight scrubbing wipes, and provides superior scrubbing capabilities. Alternatively, an extension value of less than 50 microns can also be provided with the present invention, and may be appropriate for certain end uses. Conversely, extension values in excess of 400 microns can also be achieved. In fact, extension values in excess of 1000 microns are available with the texture layer 14 of the present invention, and may be useful in certain applications.

Figure 5:
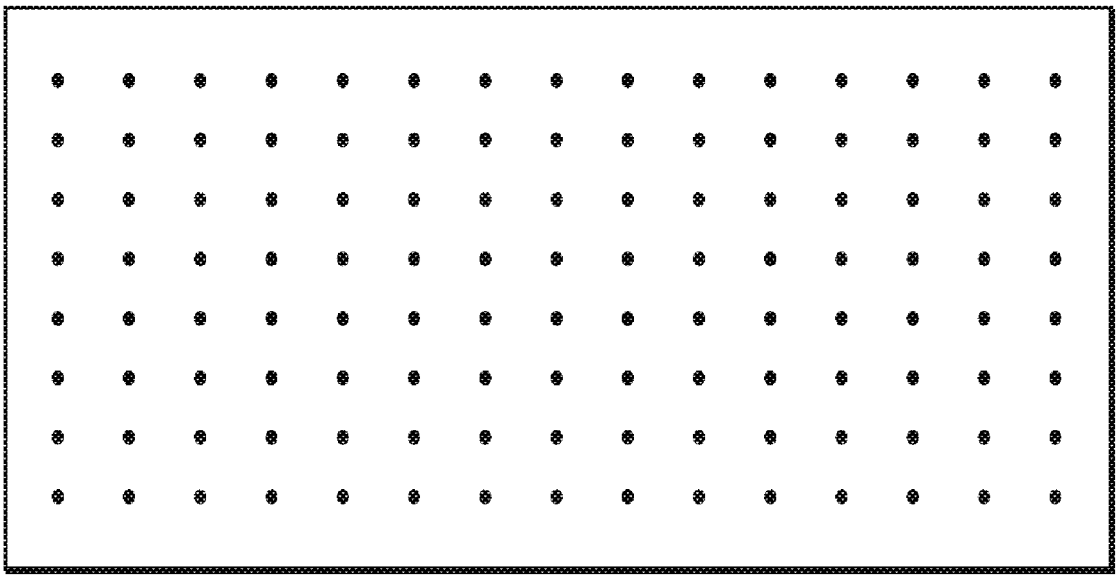
FIG. 5 is a plan view of an alternative embodiment scrubbing wipe article in accordance with the present invention.

As previously described, the texture layer 14 covers less than an entirety of the nonwoven substrate surface to which it is printed (i.e., the surface 16 of FIG. 2), and is preferably printed in a pattern including two or more discrete sections. In this regard, a wide variety of patterns can be printed. For example, the pattern can consist of a plurality of discrete lines as shown in FIG. 1. Alternatively, the lines can be connected to one another. In yet another alternative embodiment, and with additional reference to FIG. 5, the printed texture layer consists of a plurality of discrete dots or islands. Further, other desirable pattern components, such as a company logo, can be formed. Alternatively, a more random distribution of texture layer sections can be printed. In short, by printing the texture layer 14, virtually any pattern, with good definition, can be obtained. By preferably printing the texture layer 14 in a discrete pattern, a drapability or "hand" of the nonwoven substrate 12 is not drastically diminished.

Regardless of the exact dimensions and pattern of the texture layer 14, the scrubbing wipe article 10 of the present invention provides a marked improvement over previous consumer scrubbing wipes in terms of enhanced scrubbyness and ease of manufacture. Exemplary texture layer 14 compositions are provided below, and illustrate the nature in which the texture layer matrix can be fine-tuned to meet the needs of a particular end application. That is to say, for certain end use applications, a lesser degree of scrubbyness may be desirable. To meet these needs, the components and/or weight percent amounts provided by the texture layer matrix formulation can readily be varied, yet fall within the scope of the present invention.

EXAMPLE 1

A scrubbing wipe article in accordance with the present invention was prepared using a nonwoven substrate of 50/50 wt. % 1.5 denier polyester and 1.5 denier rayon formed via a spunlace operation in which a web was carded and then entangled via high-pressure water jets. A texture layer matrix was then screen printed onto the substrate, and then caused to coalesce via drying in an oven at 150° C. with a residence time of less than 2 minutes. The base nonwoven substrate prior to printing was approximately 60 g/m$^2$ and approximately 10 mils thick; after printing and drying, the resultant scrubbing wipe article was approximately 70 g/m$^2$ and approximately 20 mils thick (in regions where the texture layer was formed). The texture layer matrix formulation of Example 1 is set forth in Table 1 below.

TABLE 1

| Wt. % Added | Component |
|---|---|
| 97 | Hybridur 570 (emulsion) |
| 0 | particulate additive |
| 0.1 | Sunsperse Blue |
| 2.9 | Rheolate 255 |

EXAMPLE 2

A scrubbing wipe article similar to that described in Example 1 was prepared using a different texture layer matrix printed to an identical nonwoven substrate. The texture layer matrix of Example 2 consisted of the components provided in Table 2.

TABLE 2

| Wt. % Added | Component |
|---|---|
| 70 | Hybridur 570 (emulsion) |
| 28 | Minex 10 |
| 0.1 | Sunsperse Blue |
| 1.9 | Rheolate 255 |

EXAMPLE 3

A scrubbing wipe article similar to that described in Examples 1 and 2 was prepared using a different texture layer matrix printed to an identical nonwoven substrate. The texture layer matrix of Example 3 consisted of the components provided in Table 3.

TABLE 3

| Wt. % Added | Component |
|---|---|
| 70 | BB-077 Phenolic Resin (70% solids in water) |
| 28 | Minex 10 |
| 0.1 | Sunsperse Green |
| 1.9 | Methylcellulose |

EXAMPLE 4

A scrubbing wipe article similar to that described in Examples 1-3 was prepared using a different texture layer matrix printed to an identical nonwoven substrate. The texture layer matrix of Example 4 consisted of the components provided in Table 4.

TABLE 4

| Wt. % Added | Component |
|---|---|
| 80 | BB-077 Phenolic Resin (70% solids in water) |
| 19.9 | $Al_2O_3$ P320 |
| 0.1 | Sunsperse Green |
| 0 | thickener |

EXAMPLE 5

A scrubbing wipe article similar to that described in Examples 1-4 was prepared using a different texture layer matrix printed to an identical nonwoven substrate. The texture layer matrix of Example 5 consisted of the components provided in Table 5.

TABLE 5

| Wt. % Added | Component |
|---|---|
| 80 | Hybridur 570 (emulsion) |
| 18 | $Al_2O_3$P320 |
| 0.1 | Sunsperse Blue |
| 1.9 | Rheolate 255 |

EXAMPLE 6

A scrubbing wipe article similar to that described in Examples 1-5 was prepared using a different texture layer matrix printed to an identical nonwoven substrate. The texture layer matrix of Example 6 consisted of the components provided in Table 6.

TABLE 6

| Wt. % Added | Component |
|---|---|
| 70 | Hybridur 570 (emulsion) |
| 28 | $CaCO_3$ |
| 0.1 | Sunsperse Blue |
| 1.9 | Rheolate 255 |

EXAMPLE 7

A scrubbing wipe article similar to that described in Examples 1-6 was prepared using a different texture layer matrix printed to an identical nonwoven substrate. The texture layer matrix of Example 7 consisted of the components provided in Table 7.

TABLE 7

| Wt. % Added | Component |
|---|---|
| 70 | EMS-Griltex 9EP1 (aqueous dispersion) |
| 29.9 | Minex 10 |
| 0.1 | Sunsperse Blue |

Notably, the EMS-Griltex paste of Example 7 allowed for printing and subsequent formation of a raised texture layer from a solution in conjunction with a through-air oven. This could not be achieved with a powdered resin.

Each of Examples 1-7 above produced an acceptable scrubbing wipe article capable of cleaning surfaces in various applications, with the printed texture layer providing an enhanced scrubbyness characteristic. As a point of reference, it is possible to characterized "scrubbyness" as a function of the amount of dried-on foodsoil removed from a surface by the scrubbing wipe article when wetted and applied across the foodsoil in a scrubbing manner. One example testing methodology consists of coating a 4 inch diameter stainless steel disc (or "panel") with barbeque sauce using and R.D.S. Standard #60 Coating Rod. The so-coated panel is baked at 200° F. for 1.5 hours. The coating/baking process is then repeated two additional times for a total of three coats and approximately 2.4 grams of foodsoil on the panel. To measure a scrubbyness value, and initial weight of the prepared panel is noted. A sample of the wipe article in question is wetted to approximately 300% of its initial weight ([final weight−initial weight]/initial weight] using water. The sample and coated panel are then placed in an appropriate device capable of replicating a scrubbing motion. Following the scrubbing application, the panel is re-weighed, with the difference in panel weight (initial weight−final weight) being indicative of a scrubbyness value of the scrubbing wipe.

Relative to the specific scrubbyness values recited below, an approximately 8 inch×8 inch sample wipe was placed over a 3.75 inch disc of ScotchBrite™ Carpet Cleaning Floor Pad and attached to the upper turntable of a Schiefer Abrasion Tester (available from Frazier Precision Instrument Co. of Silver Spring, Md.). A coated panel (the initial weight of which was recorded) was placed in the metal holder on the bottom turntable. A 2 pound weight was placed on top of the Schiefer head. The head was lowered onto the bottom disc, and the machine was run 25 revolutions. The coated panel was removed, dried in an oven for 15 minutes at 200° F. and re-weighed. The scrubbyness value was defined as the difference between the initial weight of the coated panel and the final weight.

Utilizing the above-described testing procedure, the nonwoven substrate utilized in each of Examples 1-7 had a scrubbyness value of 0.5 grams. The scrubbing wipe article in accordance with Example 1 had a scrubbyness value of 0.76 grams; the scrubbing wipe article in accordance with Example 2 had a scrubbyness value of 0.84 grams; the scrubbing wipe article in accordance with Example 7 had a scrubbyness value of 0.72 grams. While no scrubbyness value data was collected pursuant to the above testing procedure for Examples 3-6, a manual review (visual and tactile) of the respective scrubbing wipe articles revealed a distinct scrubbyness attribute well in excess of that provided by the base nonwoven substrate alone. Regardless, the texture layer of the present invention enhances a scrubbyness value otherwise provided by the nonwoven substrate alone by at least 0.1 grams.

In addition to scrubbyness, the drapability of several of the above Examples was analyzed as well to confirm that the texture layer of the present invention does not overtly impact a desired drapability. To this end, drape was measured using the INDA standard for "Handle-O-Meter Stiffness of Nonwoven Fabrics" IST 90.3 (95) using a Handle-O-Meter model 211-300 with the following variations: the sample size tested was 100 mm ×.100 mm and the slot width was 100 mm. The load cell was 1000 grams. The normalized drape value for the nonwoven substrate utilized with Examples 1-7 was approximately 40.8 (normalized to the heaviest basis weight). A scrubbing wipe article in accordance with Example 2 above and printed in a dot pattern (similar to the pattern of FIG. 5) had a normalized drape value of approximately 39.9 grams-force. A scrubbing wipe article in accordance with Example 2 above and printed in a line pattern (similar to the pattern of FIG. 1) had a normalized drape value of approximately 90.2 grams-force. A scrubbing wipe article in accordance with Example 7 above and printed in a dot pattern (similar to the pattern of FIG. 5) had a normalized drape value of approximately 39.4 grams-force.

As is evidenced by the above examples, the texture layer matrix does improve the scrubbing ability of the resulting article 10 and can be fine-tuned to provide a desired scrubbyness value for the resulting scrubbing wipe article 10. Regardless of the exact formulation, the selected abrasive, non-crosslinking resin component independently imparts an appreciable scrubbyness to the wiping article 10 upon bonding to the substrate 12. Additional matrix components can be added to increase a hardness of the resulting texture layer 14, a pigment or color of the texture layer 14 and/or a viscosity of the texture layer matrix. After coalescing, the texture layer matrix comprises from about 30% -100% by weight of the non-crosslinking resin; 0%-70% by weight of a particulate mineral or filler; 0%-5% by weight of a colorant; and 0%-5% by weight of a thickener.

Although the present invention has been described with reference to preferred embodiments, workers skilled in the art will recognize that changes can be made in form and detail without departing from the spirit and scope of the present invention.

What is claimed is:

1. A consumer scrubbing wipe article comprising:

a nonwoven substrate having a dry basis weight of less than about 300 g/m$^2$; and a non-crosslinked, abrasive resin-based texture layer printed onto at least one surface of the substrate such that the texture layer extends at least 50 microns outwardly beyond the substrate surface upon coalescing;

wherein the texture layer bonds to the surface of the substrate via coalescing, and includes resin characterized as independently imparting a scrubbyness attribute to the article upon coalescing.

2. The article of claim 1, wherein the nonwoven substrate has a dry basis weight of greater than about 30 g/m$^2$.

3. The article of claim 1, wherein the nonwoven substrate is characterized by a drapability value of less than 250.

4. The article of claim 1, wherein the nonwoven substrate is characterized by the absence of a wood pulp fiber.

5. The article of claim 1, wherein the nonwoven substrate is characterized by the absence of a thermal bonding component.

6. The article of claim 1, wherein the texture layer extends at least 100 microns outwardly beyond the substrate surface.

7. The article of claim 6, wherein the texture layer extends at least 400 microns outwardly beyond the substrate surface.

8. The article of claim 1, wherein the resin is a polyacrylate.

9. The article of claim 1, wherein the resin is a polyurethane.

10. The article of claim 1, wherein the resin is a polyvinyl acetate.

11. The article of claim 1, wherein the resin is a copolyester.

12. The article of claim 1, wherein the resin is a phenolic.

13. The article of claim 1, wherein the resin is non-ionic.

14. The article of claim 1, wherein the texture layer further includes a particulate component.

15. The article of claim 14, wherein the particulate component is selected from the group consisting of a filler and a mineral.

16. The article of claim 15, wherein after coalescing, the particulate component comprises less than 70% by weight of the texture layer.

17. The article of claim 1, further comprising:

a chemical solution absorbed into the nonwoven substrate.

18. The article of claim 1, wherein the texture layer is non-fibrous.

19. The article of claim 1, wherein the texture layer is self-bonded to the surface of the substrate.

20. The article of claim 1, wherein the coalesced resin is uniformly coalesced.

* * * * *